US006205643B1

(12) United States Patent
Brinkmann et al.

(10) Patent No.: US 6,205,643 B1
(45) Date of Patent: Mar. 27, 2001

(54) METHOD FOR MANUFACTURING AN ELECTRICALLY CONDUCTIVE METALLIC STRIP

(75) Inventors: Hans W. Brinkmann, Aachen; Horst Flockenhaus, Hagen, both of (DE)

(73) Assignee: Stolberger Metallwerke GmbH & Co. KG, Stolberg (DE)

( * ) Notice: Subject to any disclaimer, the term of this patent is extended or adjusted under 35 U.S.C. 154(b) by 0 days.

(21) Appl. No.: 09/183,226

(22) Filed: Oct. 30, 1998

(30) Foreign Application Priority Data

Oct. 31, 1997 (DE) ..... 197 48 306

(51) Int. Cl.[7] ..... C22F 1/08; B21C 23/24

(52) U.S. Cl. ..... 29/527.1; 29/527.2; 148/536; 148/537; 72/47

(58) Field of Search ..... 148/536, 537; 72/47, 700; 29/527.1, 527.2, 527.4

(56) References Cited

FOREIGN PATENT DOCUMENTS 57-067187 * 4/1982 (JP) .
57-67187 * 4/1982 (JP) .
60-145342 * 1/1984 (JP) .
61-147861 * 7/1986 (JP) .
63-262448 * 10/1988 (JP) .
1159397 * 6/1989 (JP) .
04026789 * 1/1992 (JP) .

OTHER PUBLICATIONS

ASM Handbook, vol. 4, Heat Treating, p 882, 1991.*

* cited by examiner

*Primary Examiner*—George Wyszomierski
*Assistant Examiner*—Janelle Combs Morillo
(74) *Attorney, Agent, or Firm*—Kenyon & Kenyon

(57) ABSTRACT

The invention relates to a method for the manufacture of an electrically conductive metallic strip for the production of plug contact elements. A starting strip of copper or a copper alloy having an initial thickness which is greater than its final thickness is tin-plated. Subsequently, the tin-plated copper strip is deformed by rolling. This rolling process reduces both the thickness of the layer of tin and the thickness of the underlying copper strip.

5 Claims, 1 Drawing Sheet

METHOD FOR MANUFACTURING AN ELECTRICALLY CONDUCTIVE METALLIC STRIP

BACKGROUND OF THE INVENTION

The invention is directed to a method for manufacturing an electrically conductive metallic strip for the production of plug contact elements.

Plug contact connections are widely used in electrical applications. Basically, these are mechanical arrangements of contact elements for the possibly repeated opening and closing of one or several electrically conducting connections. Plug contact connections find use in extremely varied applications, for instance in motor vehicle electrical systems, information technology or industrial plant electronic systems.

It is important that the contact elements of a plug connection reliably provide an electrically well conducting connection frequently over a long period of time and under the existing ambient mechanical, electrical and climatic conditions, as well as provide for the safe disconnection of the circuit in question. Depending on the area of application, there are many embodiments of the connection in question.

A typical method for the production of such plug contact elements is to punch them out of a copper or copper alloy strip. Copper has a high degree of electrical conductivity. The copper/copper alloy strips are often tin plated to provide protection against corrosion and wear as well as to increase the surface hardness of the contact element. Tin is often used as the coating on copper because of its good corrosion resistance properties. Also, if the plug contacts are insulated with rubber, the tin coating keeps the sulfur contained in the rubber away from the copper.

Metallic tin coatings are customarily produced by electroplating, hot dipping, spray metallization, cladding, diffusion or chemical vapor deposition.

The hot dipping method in the form of hot dip tinning is in widespread use for plug contact elements. For this purpose, the copper or copper alloy strip is guided through a liquid mass of molten tin. As the result of diffusion processes between the metal atoms of the liquid tin and the copper atoms, an alloy layer is formed. When the strip is removed from the bath, it is coated with a layer of tin. Excess adhering tin is removed. This takes place by mechanically scraping the strip. In addition, the surplus tin can be removed by blown off with the aid of air or protective gas.

The coating thickness is subject to a relatively low variation. However, as compared with a rolled bright strip surface, it has higher surface roughness and is uneven. The tin-plated strip has a surface hardness corresponding to that of tin or tin alloy. The characteristics of the surface are defined by the deposition and stripping process steps from the molten state. The roughness of the surface contributes to higher insertion and withdrawal forces of any plug contact element made from the starting strip. Furthermore, the uneven surfaces result in tin abrasion in the punching die.

In this connection, a known method is to roll the tinplated strip once more in order to obtain strain-hardening of the tin plating and leveling of the surface. However, the outcome obtained in this manner with the known parameters is inadequate.

SUMMARY OF THE INVENTION

The present invention improves upon the known method and presents a superior method for the production of an electrically conductive metallic strip for use as the initial product for the manufacture of plug contact elements. As a result, the coating provided by the invention has a higher level of hardness and a lower level of surface roughness. Consequently, the plug contact elements manufactured from the strip are distinguished by lower insertion and withdrawal forces than those made by known processes.

According to the invention, a starting strip of copper or a copper alloy is provided having a greater initial thickness than its final thickness. The starting strip is provided with a coating of tin or tin alloy. Subsequently, deformation by rolling is carried out with a reduction of strip thickness until the required production thickness of the strip is reached. Production thickness is understood to be the thickness of the copper or the copper alloy strip including the layer thickness of the tin plating after the rolling process.

The rolling process, in which both the tin coating is shaped and the copper base material is deformed and reduced in thickness, results in strain-hardening of the coating and a homogenization or leveling of the surface of the tin-plated strip. The hardness of the coating can be adjusted according to the particular requirements by the rolling process and the selection of the rolling tool. This makes a defined specifiable surface hardness of the strip and the end product made from it possible.

After rolling, the,surface of the strip has low roughness. This can be influenced by the design of the roller surface. Compared to tin coatings applied by electroplating, the coefficients of friction $\mu$ are clearly lower. They are lower than 0.4.

The improved friction characteristics lead both to improved antifrictional properties of the finished strip in the punching die with reduction of the tin abrasion as well as a reduction of the required insertion and withdrawal forces of the plug contact elements produced.

Furthermore, the rolling process results in an improved bond between the tin coating and the copper base material. By suitable matching of the forming dies, the tin layer can be produced in close tolerances with reproducible mechanical properties.

The tin or tin alloy layer is preferably applied to the starting strip in a molten state. A tin or tin alloy layer with a thickness between 0.3 $\mu$m to 10 $\mu$m has proven to be particularly advantageous.

The degree of deformation of the coated starting strip is greater than or equal to 5%. Practical tests have shown that a deformation of the coated starting strip by at least 5% to production thickness results in a substantial increase of strength or hardness of the surface as well as in smoothing and freedom from defects of the coating. Optically, the coating achieves the properties of an electrolytic coating, but with lower coefficients of friction in comparison.

If necessary, the deformation by rolling can also be carried out in multiple stages. Expediently, the rolling process is integrated into the tin-plating line.

It is essential to the invention that the rolling process takes place as both a shaping of the coating and a deformation of the base material. The plug contact elements manufactured from the strip produced according to the present invention are distinguished by low insertion and withdrawal forces with a functionally perfect plug-in connection. This characteristic is retained over a defined high number of insertion and withdrawal cycles. The strip produced according to the invention thus makes possible the manufacture of high-quality plug contact elements with a low rate of wear.

An improvement of the method according to the invention provides for subjecting the starting strip to a heat treatment at a temperature between 200° C. and 650° C. before the tinplating. A temperature between 380° C. and 490° C. is considered particularly advantageous.

The heat treatment has a positive effect on the mechanical properties of the starting strip and the subsequent tin-plating process. It results in a homogeneous coating and a good bond between the base material and coating material, and serves to counteract microfissures in the diffusion layer. Internal tensile stresses in the coating, which can result in crack formation and deterioration of the mechanical properties of the finished parts, are avoided.

An additional rolling process can be carried out on the starting strip between the heat treatment and the tin-plating. This deforms the starting strip to a prefinished thickness and it is then tin-plated in this state. After that, the finish rolling process is carried out. A heat treatment can again be carried out before tin-plating in which the strip is soft annealed or annealed to hardness or thermal stress relief is carried out. This provides the copper material of the starting strip with the desired properties for further processing and reduces internal stresses.

In addition, it can be advantageous to subject the starting strip to a heat treatment at a temperature of up to 200° C. after tin-plating.

When the coated copper or copper alloy strip is heat treated before the deformation step, the temperature should be below the melting point of the coating material.

A heat treatment can also be carried out after the production thickness has been achieved. In this case, preferably only the character of the tin layer is changed.

The above-described heat treatment measures ensure that the required mechanical properties of the strip are achieved in each particular processing step.

BRIEF DESCRIPTION OF THE DRAWINGS

The invention will be described in greater detail below with reference to an exemplary embodiment presented schematically in the drawings.

DETAILED DESCRIPTION

Figure 1:
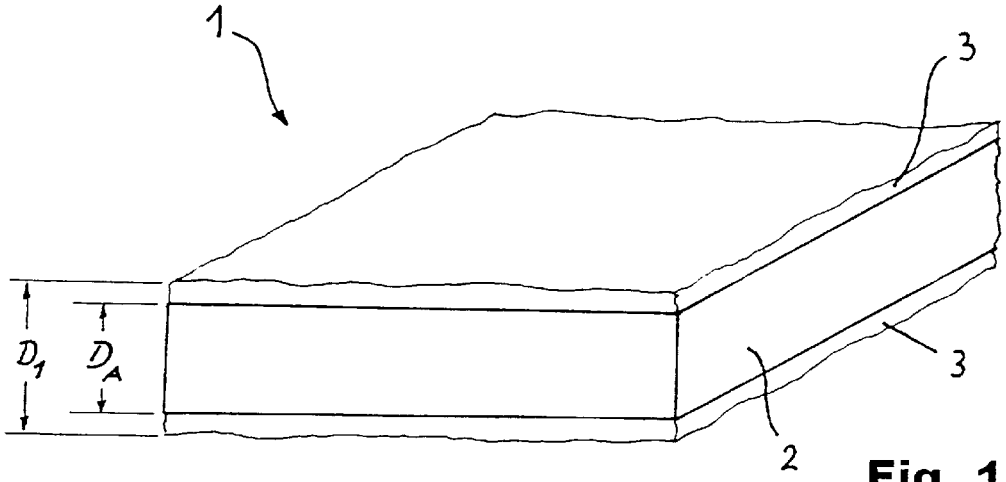
FIG. 1 shows a section of a tin-plated strip 1 in which the starting strip 2 of copper or a copper alloy has been provided with a coating 3 of tin or a tin alloy on both sides.
Figure 2:
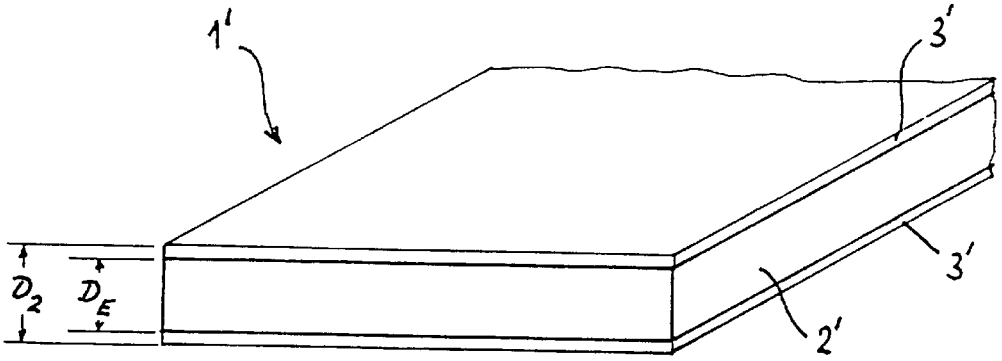
FIG. 2 shows the strip after the strip thickness has been reduced to the desired production thickness by rolling.

The initial thickness $D_A$ of the starting strip 2 is greater than the final thickness $D_E$ of strip 1' or 2' that results from rolling. The drawings are not to be understood as true to scale. In practice, the initial thickness $D_A$ is in a range between 0.10 mm to 1.20 mm. The rolling of strip 1 levels the surface roughness of coating 3 provided by the tin-plating. The surface roughness of coating 3 is presented in FIG. 1 by the wavy lines.

In the rolling process, both coating 3 as well as starting strip 2 are deformed. This reduces, evens out and strain-hardens the layer thicknesses. A leveling of the surface roughness of coating 3' is achieved with a simultaneous increase of surface hardness.

The plug contact elements manufactured from strip 1' are therefore distinguished by low insertion and withdrawal forces. The improved anti-frictional properties further increase the number of the insertion and withdrawal operations of the finished plug contact elements.

Starting strip 1 can be subjected to a heat treatment before tin-plating. A heat treatment of strip 1' after the conclusion of the deformation by rolling is also advantageous. A heat treatment between the individual processing steps is also within the scope of this invention.

The degree of deformation of starting strip 2 may be between 5% and 80%. Theoretically, a reduction by rolling up to the maximum deformability of the material is possible. The process parameters are illustrated by the use of a practical example. A starting strip 2 is rolled to an initial thickness $D_A$ of 1.00 mm in a preliminary operation and then heat treated in an annealing process. This may be followed by stretcher and roller leveling.

For an initial thickness $D_A$ of 1.00 mm, starting strip 2 is tin-plated to a layer thickness between 0.3 $\mu$m and 10 $\mu$m. In the finish rolling operation, initial thickness $D_A$ is reduced to a final thickness $D_E$ of 0.50 mm. This corresponds to a degree of deformation of 50%. The surface roughness is less than 0.3 $\mu$m after the finish rolling operation.

Following the finish rolling operation, strip 1' is divided into longitudinal strips, which are sent to the plug contact element production operation.

What is claimed is:

1. A method for manufacturing an electrically conductive metallic strip for use in the production of plug contact elements in which a starting strip is made of copper or a copper alloy and has an initial thickness which is greater than its final thickness, comprising the steps of:

subjecting the starting strip to a heat treatment at a temperature between 200° C. and 650° C.;

coating the starting strip with a coating of tin or a tin alloy after the starting strip has been subjected to the heat treatment;

subsequently rollingly deforming the coated starting strip so as to reduce its thickness to a production thickness; and heating said strip to an elevated temperature which is above room temperature and performing a heat treatment at said elevated temperature after the final production thickness is reached.

2. A method as set forth in claim 1, wherein the degree of deformation imposed on the coated starting strip is at least 5%.

3. A method as set forth in claim 2, wherein an additional rolling operation is carried out on the starting strip between the heat treatment and the tin-plating.

4. A method as set forth in claim 1, wherein the starting strip is subjected to a heat treatment at an elevated temperature which is above room temperature and up to 200° C. after the strip has been coated with tin.

5. A method as set forth in claim 2, wherein the starting strip is subjected to a heat treatment at an elevated temperature which is above room temperature and up to 200° C. after the strip has been coated with tin.

* * * * *